US007378793B2

(12) United States Patent
Kang

(10) Patent No.: US 7,378,793 B2
(45) Date of Patent: May 27, 2008

(54) PLASMA DISPLAY PANEL HAVING MULTIPLE SHIELDING LAYERS

(75) Inventor: Seok Dong Kang, Kumi-shi (KR)

(73) Assignee: LG Electronics Inc., Seoul (KR)

( * ) Notice: Subject to any disclaimer, the term of this patent is extended or adjusted under 35 U.S.C. 154(b) by 277 days.

(21) Appl. No.: 10/800,036

(22) Filed: Mar. 15, 2004

(65) Prior Publication Data

US 2004/0239249 A1 Dec. 2, 2004

Related U.S. Application Data

(63) Continuation-in-part of application No. 10/291,605, filed on Nov. 12, 2002, now Pat. No. 6,727,648.

(30) Foreign Application Priority Data

Nov. 13, 2001 (KR) ..... P2001-70466

(51) Int. Cl.
*H01J 17/49* (2006.01)

(52) U.S. Cl. ..... 313/582; 313/587; 313/479

(58) Field of Classification Search ..... 313/582, 313/461, 466, 473, 479, 112
See application file for complete search history.

(56) References Cited

U.S. PATENT DOCUMENTS

| | | | | |
|---|---|---|---|---|
| 4,854,936 | A | 8/1989 | Ono et al. | 427/80 |
| 5,952,782 | A * | 9/1999 | Nanto et al. | 313/584 |
| 6,075,319 | A | 6/2000 | Kanda et al. | 313/584 |
| 6,156,433 | A | 12/2000 | Hatori et al. | 428/411.1 |
| 6,433,477 | B1 * | 8/2002 | Ha et al. | 313/586 |
| 6,465,956 | B1 * | 10/2002 | Koshio et al. | 313/586 |
| 6,486,611 | B2 * | 11/2002 | Tokunaga et al. | 315/169.4 |
| 6,492,770 | B2 * | 12/2002 | Amemiya et al. | 313/586 |
| 6,614,183 | B2 * | 9/2003 | Masuda et al. | 313/586 |
| 6,650,051 | B1 | 11/2003 | Park et al. | 313/582 |
| 2001/0011871 | A1 * | 8/2001 | Amemiya et al. | 313/586 |
| 2001/0017520 | A1 | 8/2001 | Masuda et al. | 313/586 |

FOREIGN PATENT DOCUMENTS

| | | |
|---|---|---|
| CN | 1289140 | 3/2001 |
| EP | 0 740 183 | 10/1996 |
| EP | 406 288 | 4/2004 |
| JP | 10-40821 | 2/1998 |
| JP | 10-92325 | 4/1998 |
| JP | 200-156166 | 6/2000 |
| JP | 11-329257 | 9/2000 |
| JP | 200251774 | 9/2000 |

* cited by examiner

*Primary Examiner*—Toan Ton
*Assistant Examiner*—Kevin Quarterman
(74) *Attorney, Agent, or Firm*—Ked & Associates, LLP

(57) ABSTRACT

The present invention relates to a plasma display panel, that is capable of preventing the discoloration of a substrate caused by migration of a metal bus electrode or metal paste's running down.

The plasma display panel includes a transparent electrode; a metal bus electrode; a first light shielding layer formed between the transparent electrode and the metal bus electrode on each discharge cell; a second light shielding layer formed between the adjacent discharge cells. The first light shielding layer and the second light shielding layer are different from each other in at least one of a thickness and a pigment concentration.

44 Claims, 6 Drawing Sheets

PLASMA DISPLAY PANEL HAVING MULTIPLE SHIELDING LAYERS

This is a continuation-in-part of U.S. patent application Ser. No. 10/291,605 filed on Nov. 12, 2002 (now U.S. Pat. No. 6,727,648), the benefit of the filing date of which is hereby claimed under 35 U.S.C. 120.

BACKGROUND OF THE INVENTION

1. Field of the Invention

The present invention relates to a plasma display panel, and more particularly to a plasma display panel that is capable of preventing the discoloration of a substrate caused by migration of a metal bus electrode or metal paste's running down. Further, the present invention relates to a plasma display panel that is capable of improving a display quality.

2. Description of the Related Art

Generally, a plasma display panel (PDP) radiates a fluorescent body by an ultraviolet with a wavelength of 147 nm generated during a discharge of He+Xe or Ne+Xe gas to thereby display a picture including characters and graphics. Such a PDP is easy to be made into a thin-film and large-dimension type. Moreover, the PDP provides a highly improved picture quality owing to a recent technical development. Particularly, a three-electrode, alternating current (AC) surface-discharge type PDP has advantages of a low-voltage driving and a long life in that it can lower a voltage required for a discharge using wall charges accumulated on the surface thereof during the discharge and protect the electrodes from a sputtering caused by the discharge. Further, the PDP has advantages that its fabricating process is simple, it is easier to be made into a large screen and its response speed is fast because it does not have to form an active switching device every cell in the same way as a liquid crystal display (LCD).

Referring to FIG. 1, a discharge cell of the three-electrode, AC surface-discharge PDP includes a scanning electrode 30Y and a sustaining electrode 30Z formed on an upper substrate 10, and an address electrode 20X formed on a lower substrate 18.

The scanning electrode 30Y and the sustaining electrode 30Z include a transparent electrode 12Y or 12Z, and a metal bus electrode 13Y or 13Z having a smaller line width than the transparent electrode 12Y or 12Z and provided at one edge of the transparent electrode, respectively. The transparent electrodes 12Y and 12Z are formed on the upper substrate 10 and are made of indium-tin-oxide ITO. The metal bus electrodes 13Y and 13Z are formed by going through an etching process after depositing chrome/copper/chrome (Cr/Cu/Cr) by a deposition method, or by going through a patterning and firing process after printing photosensitive silver paste. On the upper substrate 10 provided with the scanning electrode 30Y and the sustaining electrode 30Z, an upper dielectric layer 14 and a protective film 16 are disposed. Wall charges generated upon plasma discharge are accumulated in the upper dielectric layer 14. The protective film 16 protects the upper dielectric layer 14 from a sputtering generated during the plasma discharge and improves the emission efficiency of secondary electrons. This protective film 16 is usually made of magnesium oxide (MgO). The address electrode 20X is formed in a direction crossing the scanning electrode 30Y and the sustaining electrode 30Z. A lower dielectric layer 22 and barrier ribs 24 are formed on the lower substrate 18 provided with the address electrode 20X. A fluorescent material layer 26 is coated on the surfaces of the lower dielectric layer 22 and the barrier ribs 24. The barrier ribs 24 are formed in parallel to the address electrode 20X to define the discharge cell physically and prevent an ultraviolet ray and a visible light generated by the discharge from being leaked into the adjacent discharge cells. The fluorescent material layer 26 is excited and radiated by an ultraviolet ray generated upon plasma discharge to produce a red, green or blue color visible light ray. An inactive mixture gas, such as He+Xe or Ne+Xe, for a gas discharge is injected into a discharge space defined between the upper and the lower substrates 10 and 18 and the barrier ribs 24.

Such a three-electrode AC surface-discharge PDP drives one frame, which is divided into a plurality of sub-fields having a different emission frequency, so as to realize gray levels of a picture. Each sub-field is again divided into a reset interval for uniformly causing a discharge, an address interval for selecting the discharge cell and a sustaining interval for realizing the gray levels depending on the discharge frequency. When it is intended to display a picture of 256 gray levels, a frame interval equal to 1/60 second (i.e. 16.67 msec) in each discharge cell is divided into 8 sub-fields SF1 to SF8. Each of the 8 sub-fields SF1 to SF8 is divided into a reset interval, an address interval and a sustaining interval. The reset interval and the address interval of each sub-field are equal every sub-field, whereas the sustaining interval and the discharge frequency are increased at a ratio of $2^n$ (wherein n=0, 1, 2, 3, 4, 5, 6 and 7) at each sub-field. Since the sustaining interval becomes different at each sub-field as mentioned above, the gray levels of a picture can be realized.

By the way, the conventional PDP has a problem of discoloration of the substrate 10 caused by migration of the metal bus electrodes 13 and 13Z or the fact that silver (Ag) paste runs down the substrate 10 in case that the silver (Ag) paste is printed to form the metal bus electrodes 13Y and 13Z. The migration means that cation of silver Ag+ is eluted from an anode and moves to a cathode under dissolved oxygen in case of there being a voltage difference between two adjacent electrodes, which are the cathode and anode respectively. Sometimes, the cation of silver eluted discolors the surface of the substrate 10 in such migration process. The most significant cause of such substrate discoloration lies in an upper plate structure of the PDP. That will be described in detail in conjunction with FIGS. 2 and 3.

Referring to FIG. 2, metal bus electrodes 13Y and 13Z formed in a conventional PDP has their outer edge go in more by a certain length δ toward the center of a cell than the outer edge of transparent electrodes 12Y and 12Z located at the outer area of the cell. And the inner edge of the conventional metal bus electrodes 13Y and 13Z goes in more by a certain length t0 toward the outer of a cell than the inner edge of transparent electrodes 12Y and 12Z. There is a black layer 28 with conductivity formed between the metal bus electrodes 13Y and 13Z and the transparent electrodes 12Y and 12Z. The black layer 28 is formed by oxidizing metal or printing and patterning paste where metal powder and black pigment are mixed together. The black layer 28 act to prevent a contrast deterioration of a display screen caused by external light being reflected from the metal bus electrode 13Y and 13Z by absorbing the external light.

According to a structure of the metal bus electrodes 13Y and 13Z as in FIG. 2, the silver Ag paste is likely to run down to the transparent electrodes 12Y and 12Z or the substrates 10 so as to cause the substrate 10 to be discolored when the silver Ag paste is printed to form the metal bus electrodes 13Y and 13Z. This is because the outer edges of the metal bus electrodes 13Y and 13Z are close to the transparent electrodes 12Y and 12Z or the substrate 10. Further, anion of the metal bus electrodes 13Y and 13Z is likely eluted to discolor the substrate 10 by such a structure.

There is a PDP where an oxide film is formed on the substrate 10 as in FIG. 3 as another scheme for reducing the problem of the substrate discoloration.

Referring to FIG. 3, another conventional PDP includes an oxide film 30 formed of silicon oxide SiO between transparent electrodes 12Y and 12Z and a substrate 10. In this PDP, metal bus electrodes 13Y and 13Z has their outer edge go in more by a certain length δ toward the center of a cell than the outer edge of transparent electrodes 12Y and 12Z located at the outer area of the cell. And the inner edge of the metal bus electrodes 13Y and 13Z goes in more by a certain length to toward the outer of a cell than the inner edge of transparent electrodes 12Y and 12Z. There is a black layer 28 with conductivity formed between the metal bus electrodes 13Y and 13Z and the transparent electrodes 12Y and 12Z. The oxide film 30 is formed between the metal bus electrodes 13Y and 13Z and the substrate 10 so as to shut off for silver paste or silver ion eluted from the metal bus electrodes 13 and 13*z* not to move toward the substrate 10.

However, in case that the oxide film is formed on the PDP as in FIG. 3, because it has lower transparency than glass, the aperture ratio and brightness of the PDP is deteriorated and equipment and a process for depositing the oxide film should be additionally required.

Moreover, since the PDP as in FIG. 2 or 3 has the metal bus electrode 13Y and 13Z biased toward the inner side of a discharge cell, so there is a problem of the aperture ratio being that much smaller.

Particularly, since the light is leaked into the direction of adjacent discharge cells C1 and C2 through a boundary area BD between the adjacent discharge cells C1 and C2, the PDP in FIGS. 2 and 3 has a bad contrast, and since the light incident by the black layer 28 via metal bus electrodes 13Y and 13Z is shut off, a brightness is deteriorated, thereby having a problem of a bad display quality as shown in FIG. 4.

SUMMARY OF THE INVENTION

Accordingly, it is an object of the present invention to provide a plasma display panel PDP that is capable of preventing discoloration of a substrate caused by migration of a metal bus electrode or metal paste's running down.

Another object of the present invention is to provide a PDP that is capable of improving a display quality.

In order to achieve these and other objects of the invention, a plasma display panel according to embodiments of the present invention includes a transparent electrode; a metal bus electrode; a first light shielding layer formed between the trans parent electrode and the metal bus electrode on each discharge cell; and a second light shielding layer formed between the adjacent discharge cells, wherein the first light shielding layer and the second light shielding layer are different from each other in at least one of a thickness thereof and a concentration of a pigment thereof.

The plasma display panel of claim 1, wherein the first light shielding layer and the second shielding layer are connected to each other.

The plasma display panel further includes a substrate having the transparent electrode formed thereon, wherein the second light shielding layer is commonly connected to the transparent electrodes formed in each of the adjacent discharge cells.

The plasma display panel further comprises a substrate having the transparent electrode formed thereon, wherein the second light shielding layer is electrically connected to the transparent electrodes formed in each of the adjacent discharge cells.

The thickness of the first light shielding layer is thinner than that of the second light shielding layer.

The thickness of the first light shielding layer is thinner by about 0.1 μm~2 μm than that of the second light shielding layer.

The pigment concentration of the first light shielding layer is lower than that of the second light shielding layer.

The pigment concentration of the first light shielding layer is lower by about 1%~10% than that of the second light shielding layer.

The pigment of the first and the second light shielding layers is a non-conductive pigment.

The pigment of the first and the second light shielding layers includes at least one of a cobalt oxide $Co_xO_y$, an iron oxide $Fe_xO_y$, a chrome oxide $Cr_xO_y$ and a manganese oxide $Mn_xO_y$.

The concentration of the pigment is about 70% in the first and the second light shielding layers.

The pigment of the first light shielding layer comprises a conductive pigment.

The pigment of the first light shielding layer includes a ruthenium oxide $Ru_xO_y$.

The concentration of the pigment in the first light shielding layer is about 60%~69%.

A plasma display panel comprises a transparent electrode; a metal bus electrode; a first light shielding layer formed between the transparent electrode and the metal bus electrode on each discharge cell; and a second light shielding layer formed between adjacent cells.

A plasma display panel comprises a transparent electrode; a metal bus electrode; a first light shielding layer formed between the transparent electrode and the metal bus electrode on each discharge cell; and a second light shielding layer formed between the adjacent cells, wherein each of the first and the second light shielding layers has a different light shielding ratio from each other.

The light shielding ratio of the first light shielding layer is lower than that of the second light shielding layer.

The light shielding ratio of the first light shielding layer is lower by 0.1%~5% than that of the second light shielding layer.

The first light shielding layer and the second light shielding layer are different from each other in at least one of a thickness and a pigment concentration.

The thickness of the first light shielding layer is thinner than that of the second light shielding layer; and the pigment concentration of the first light shielding layer is lower than that of the second light shielding layer.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Hereinafter, the preferred embodiments of the present invention will be described in detail with reference to FIGS. 5 and 9.

Figure 5:
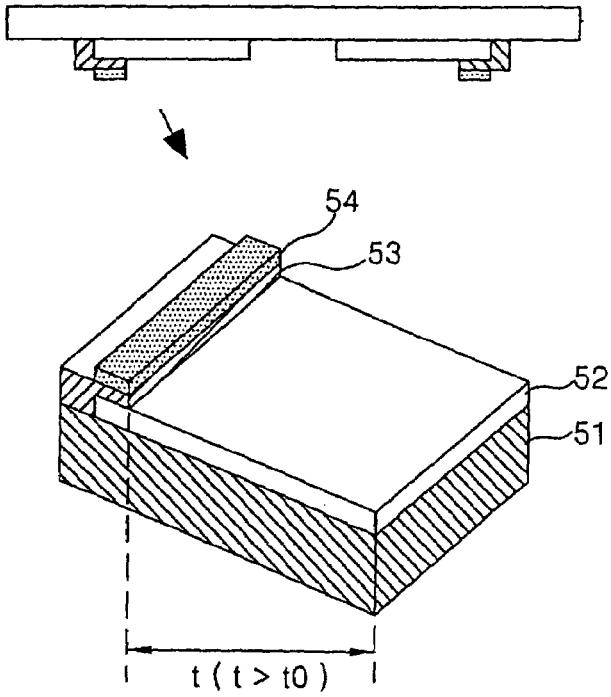
FIG. 5 shows a portion of an upper plate of a PDP according to a first embodiment of the present invention.
Figure 6:
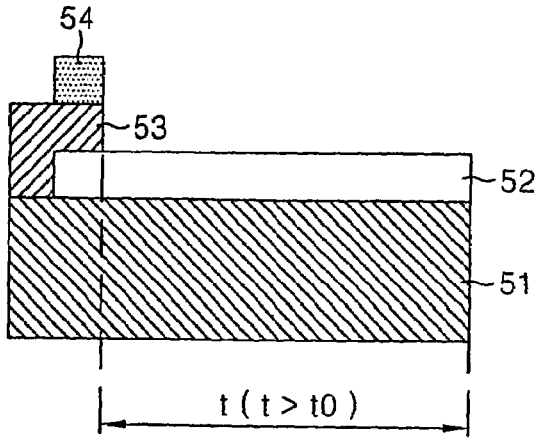
FIG. 6 is a cross-sectional view of a set of the transparent electrode, the black layer and the metal bus electrode shown in FIG. 4.

Referring to FIGS. 5 and 6, a PDP according to a first embodiment of the present invention includes a transparent electrode 52 formed on an upper substrate 51, a black layer 53 covering the outside edge and a portion of an upper surface of the transparent electrode 52, and a metal bus electrode 54 formed on the transparent electrode 52 with the black layer 53 therebetween.

The upper substrate 51 is made from materials such as transparent glass, plastic and ceramic. A scanning electrode or a sustaining electrode is composed of the transparent electrode 52, the metal bus electrode 54 and the black layer 53 as deposited.

The black layer 53 covers the outer upper surface of the transparent electrode 52 close to a discharge space within a discharge cell and is bent at the outer edge of the transparent electrode 52 to cover the outer side of the transparent electrode 52. The black layer 53 is formed by oxidizing a metal or printing and patterning a paste in which metal powder and black pigment are mixed together. It is preferred that a concentration of a conductive pigment of the black layer, for instance, a ruthenium oxide $Ru_xO_y$ is about 70% in the black layer 53 in consideration of light shielding and conductivity.

The black layer 53 absorbs an external light incident to the metal bus electrode 54 or an external light reflected from the metal bus electrode 54 to increase contrast (or visibility), and in case that silver paste runs down in a printing process of the metal bus electrode 54, the distance between the metal bus electrode 54 and the upper substrate 51 is made to be extended as compared with the prior art, thereby preventing a discoloration of the upper substrate 51 caused by electrode material. Further, the black layer 53 has the distance between the metal bus electrode 54 and the upper substrate 51 extended to shut off a migration due to an ion elution of the electrode material, thereby preventing the discoloration of the upper substrate 51.

The area of the black layer 53 is 1.5 times as big as the area of the metal bus electrode 54. The end of the outer edge of the black layer 53 is in contact with the upper substrate 51.

The black layer 53 is located between the metal bus electrode 54 and the upper substrate 51 while not being overlapped with or not being coupled to a black layer of an adjacent discharge cell in order for the metal bus electrode 54 not to make direct contact to the upper substrate 51 when changing the structure of the transparent electrode 52 or the metal bus electrode 54.

Figure 2:
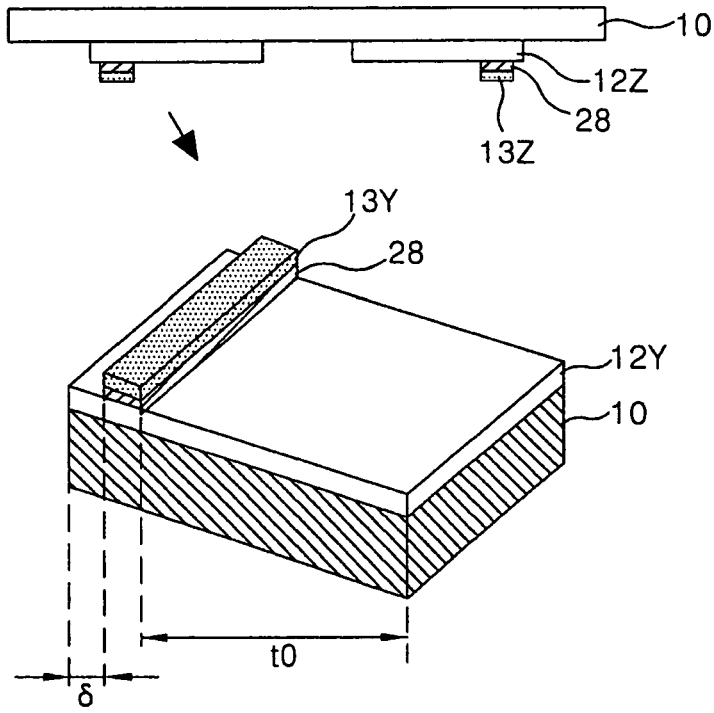
FIG.2 RELATED ART
FIG. 2 illustrates in detail a portion of an upper plate of the PDP including a metal bus electrode shown in FIG. 1.
Figure 3:
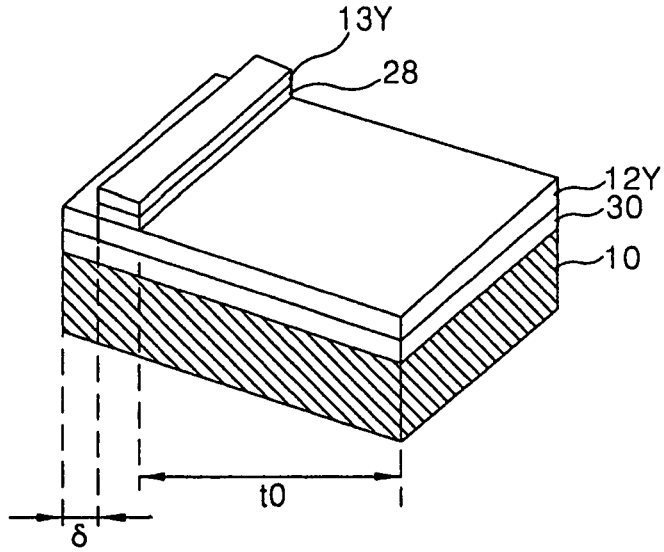
FIG.3 RELATED ART
FIG. 3 is a sectional perspective view of a portion of an upper plate of another related art PDP where an oxide film is formed.
Figure 4:
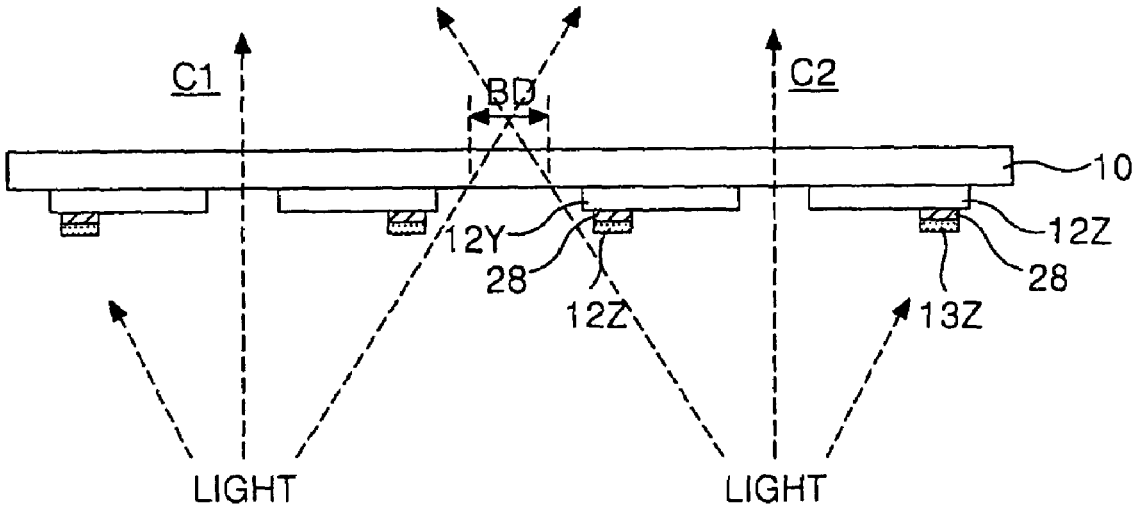
FIG. 4 RELATED ART
FIG. 4 illustrates a light leakage between adjacent cells in the related art PDP.

The outer edge of metal bus electrode 54 and the outer edge of the transparent electrode 52 are substantially same in their location or are located on the same vertical line. And, the metal bus electrode 54 is biased toward the outer side of a discharge cell which is separated by a distance of t from the inner edge of the transparent electrode 52. As can be seen in FIGS. 2 and 5, the distance between the inner edge of the metal bus electrode 54 and the inner edge of the transparent electrode 52 is extended from t0 to t, where t is greater than t0. Accordingly, the metal bus electrode 54 has its width set narrow and is positioned a little to the outer side of the discharge cell so as to increase an aperture ratio and brightness of each discharge cell as much.

Figure 1:
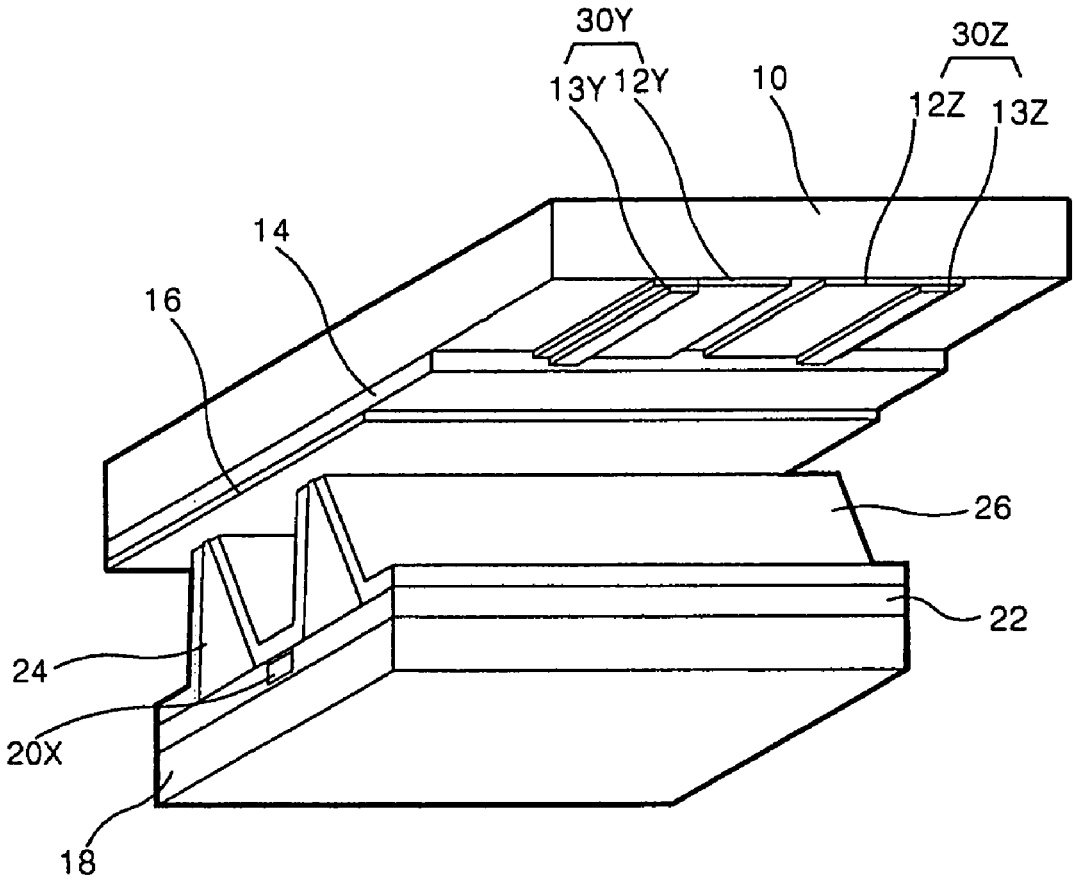
FIG. 1 RELATED ART
FIG. 1 is a perspective view of a discharge cell structure of a conventional three-electrodes AC surface discharge type PDP.

On an upper plate of the PDP is also formed a dielectric layer (not shown) deposited on the upper substrate and a protective film (not shown) to cover the transparent electrode 52, the black layer 53 and the metal bus electrode 54. The upper plate of the PDP with such a structure is combined to a lower plate shown in FIG. 1 and they were sealed. There is inactive mixture gas such as He+Xe, Ne+Xe or He+Ne+Xe injected into a discharge space between the upper plate and the lower plate.

Figure 7:
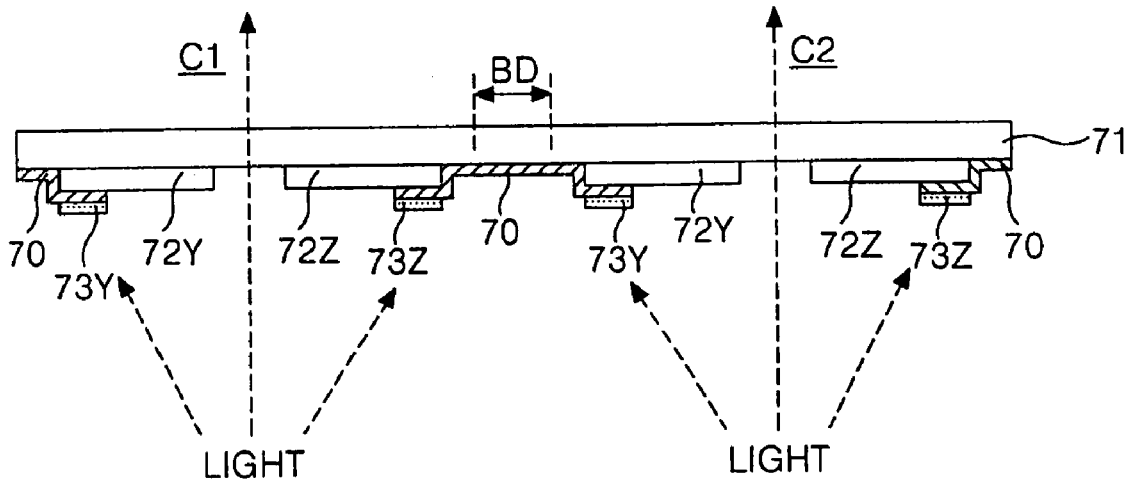
FIG. 7 is a cross-sectional view of a portion of an upper plate of a PDP according to a second embodiment of the present invention.

FIG. 7 is a cross-sectional view of a portion of an upper plate of a PDP according to a second embodiment of the present invention.

Referring to FIG. 7, the PDP according to the second embodiment of the present invention includes a transparent electrode 72 formed on the upper substrate 71 and a black layer 70 formed between adjacent discharge cells C1 and C2 and between transparent electrodes 72Y and 72Z and metal bus electrodes 73Y and 73Z for each of the discharge cells C1 and C2.

The transparent electrode 72Y and the metal bus electrode 73Y located on one side of each of the discharge cells C1 and C2 is comprised of a scanning electrode to which a scanning signal for selecting a horizontal line of the PDP for an address interval is applied and a sustaining pulse for causing a sustain discharge is applied for the discharge cell selected by an address discharge for a sustaining interval. Moreover, the transparent 72Z and the metal bus electrode 73Z located on the other side of each of the discharge cells C1 and C2 is comprised of a sustain electrode to which a sustaining pulse is applied in alternating fashion with the scanning electrode to allow the discharge cell selected by the address discharge to cause a sustain discharge.

The upper substrate 71 is made of materials such as transparent glass, plastic and ceramic.

The black layer 70 is formed between the transparent electrodes 72Y and 72Z and the metal bus electrodes 73Y and 73Z at each of the discharge cells C1 and C2. Furthermore, the black layer 70 is formed on the upper substrate 71 between the adjacent discharge cells C1 and C2 via a boundary area BD, and connected to the transparent electrodes 72Y and 72Z neighboring the adjacent discharge cells C1 and C2.

It is preferred that a concentration of the pigment having a high resistivity or non-conductivity, for instance, a cobalt oxide $Co_xO_y$, an iron oxide $Fe_xO_y$, a chrome oxide $Cr_xO_y$ and a manganese oxide $Mn_xO_y$, etc. is about 70% in a black paste of the black layer 70 in order for two electrodes neighboring the adjacent discharge cells C1 and C2 not to be electrically shorted. In addition to the pigment, a concentration of an organic binder, a surfactant and other additives is about 30% in the black paste.

To form the black layer 70, a process for fabricating the upper plate includes a printing process for printing the same compositional black paste as mentioned above through a screen and a mask on the upper substrate 71 provided with the transparent electrodes 72Y and 72Z and a firing process for solidifying the black paste. The black layer 70 formed between the transparent electrodes 72Y and 72Z and the metal bus electrodes 73Y and 72Z, and the black layer 70 formed between the adjacent discharge cells C1 and C2 via a boundary area BD are same in thickness and formed at the same time.

The black layer 70 absorbs an external light incident to the metal bus electrodes 73Y and 73Z or a light reflected from the metal bus electrodes 73Y and 73Z to enhance contrast (or visibility), and absorbs a light irradiated from the adjacent discharge cells to enhance contrast (or visibility). Moreover, in case that silver paste runs down during the printing process of the metal bus electrodes 73Y and 73Z, the black layer 70 has the distance between the metal bus electrodes 73Y and 73Z and the upper substrate 71 made to be extended as compared with the related art, thereby preventing a discoloration of the upper substrate 71 caused by electrode material. Further, the black layer 70 has the distance between the metal bus electrodes 73Y and 73Z and the upper substrate 71 made to be extended to shut off a migration due to an ion elution of the electrode material, thereby preventing the discoloration of the upper substrate 71.

The metal bus electrodes 73Y and 73Z have a pad connected to an external driving circuit at their ends, and receive the driving signal such as the scanning pulse or the sustaining pulse from the external driving circuit. The outer edges of the metal bus electrodes 73Y and 73Z has substantially the same scheme as the outer edges of the transparent electrodes 72Y and 72Z or are located on the same vertical line as those of the transparent electrodes 72Y and 72Z. Moreover, the metal bus electrodes 73Y and 73Z may go in more by a certain length toward the center of the discharge cell from the outer edge. Further, the inner edge of the metal bus electrodes 73Y and 73Z is separated by the length t from the inner edge of the transparent electrodes 72Y and 72Z as similar as the first embodiment described above, thereby going in more toward the outer than the related art.

On an upper plate of the PDP, a dielectric layer (not shown) deposited on the upper substrate 71 and a protective film (not shown) are further formed to cover the transparent electrodes 72Y and 72Z, the black layers 70 and the metal bus electrodes 73Y and 73Z. The upper plate of the PDP with such a structure is jointed to and selected with a lower plate shown in FIG. 1 and an inactive mixture gas such as He+Xe, Ne+Xe or He+Ne+Xe is injected into a discharge space arranged between the upper plate and the lower plate.

Figure 8:
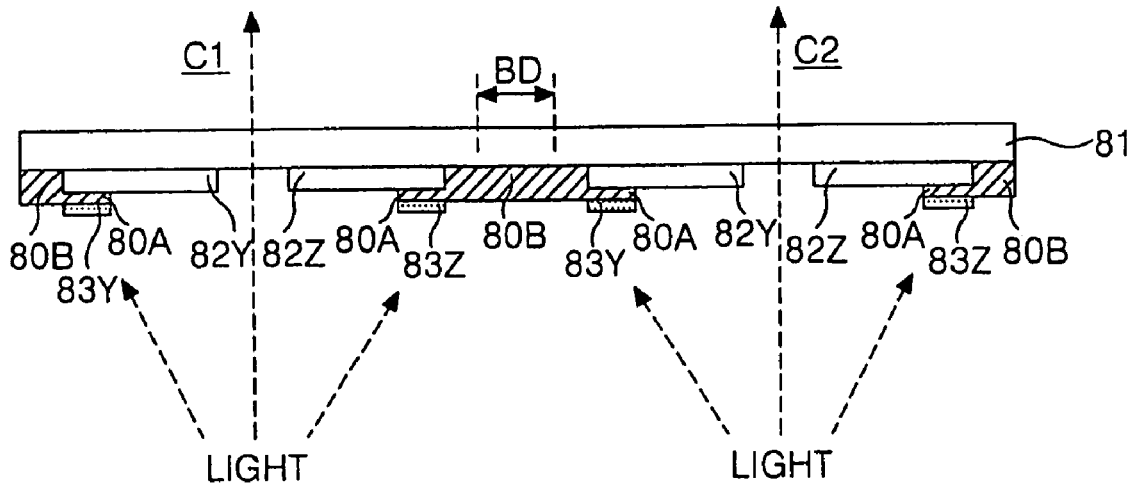
FIG. 8 is a cross-sectional view of a portion of an upper plate of a PDP according to a third embodiment of the present invention.

FIG. 8 is a cross-sectional view of an upper plate of a PDP according to a third embodiment of the present invention.

Referring to FIG. 8, the PDP according to the third embodiment of the present invention includes a transparent electrode 82 formed on an upper substrate 81 and black layers 80A and 80B formed on the upper substrate 81 at each of the adjacent discharge cells C1 and C2 and formed between transparent electrodes 82Y and 82Z and metal bus electrodes 83Y and 83Z at each of the discharge cells C1 and C2, wherein the black layers 80A and 80B have light transmittances which are partially different from each other.

The transparent electrodes 82Y and the metal bus electrode 83Y located on one side of each of the discharge cells C1 and C2 is comprised of a scanning electrode to which a scanning signal for selecting a horizontal line of the PDP for an address interval is applied and a sustaining pulse for causing a sustain discharge is applied for the discharge cell selected by an address discharge for a sustaining interval. Moreover, the transparent 82Z and the metal bus electrode 83Z located on the other side of each of the discharge cells C1 and C2 is comprised of a sustain electrode to which a sustaining pulse is applied in alternating fashion with the scanning electrode to allow the discharge cell selected by the address discharge to cause a sustain discharge.

The upper substrate 81 is made of materials such as transparent glass, plastic and ceramic.

The black layers 80A and 80B include a first black layer 80A formed between the transparent electrodes 82Y and 82Z and the metal bus electrodes 83Y and 83Z at each of the discharge cells C1 and C2; and a second black layer 80B formed on the upper substrate 81 between the adjacent discharge cells C1 and C2 via a boundary area BD, and connected to the transparent electrodes 82Y and 82Z neighboring the adjacent discharge cell C1 and C2.

A light shielding ratio of the first black layer 80A is lower by about 0.1%~5%, preferably about 0.1%~3%, than that of the second black layer 80B. For instance, the light shielding ratio of the first black layer 80A may be about 95%. In contrast, the light shielding ratio of the second black layer 80B is higher by about 96% than that of the first black layer 80A.

The higher the light shielding ratio of the first black layer 80A is, the more a light irradiated from a phosphorous material (not shown), transmit the metal bus electrodes 83Y and 83Z, transmitting the first black layer 80A and then going toward a display surface becomes, thereby enhancing the brightness of the discharge cell.

As the light shielding ratio of the second black layer 80B is lower, an undesirable light irradiated from the adjacent discharge cell is shielded, thereby enhancing the contrasts of the adjacent discharge cells C1 and C2.

In case that a silver paste runs down for a printing process of the metal bus electrodes 83Y and 83Z, the distance between the metal bus electrodes 83Y and 83Z and the upper substrate 81 is made to be extended as compared with the related art, thereby preventing a discoloration of the upper substrate 81. Further, the second black layer 80B has the distance between the metal bus electrodes 83Y and 83Z and the upper substrate 81 extended to shut off a migration due to an ion elution of the electrode material, thereby preventing the discoloration of the upper substrate 81 caused by electrode material.

To make the light shielding ratio of the first and the second black layers 80A and 80B different from each other, the thickness of the first black layer 80A is thinner by about 0.1 μm~2 μm than that of the second black layer 80B. For instance, the thickness of the first black layer 80A may be selected within 2 μm while the thickness of the second black layer 80B may be selected in the range of 2 μm~4 μm.

It is preferred that the concentration of the pigment having a high resistivity or non-conductivity, for instance, a cobalt oxide $Co_xO_y$, an iron oxide $Fe_xO_y$, a chrome oxide $Cr_xO_y$ and a manganese oxide $Mn_xO_y$, etc. is occupied about 70% in the black paste of the black layer 80 so that two electrodes neighboring the adjacent discharge cells C1 and C2 are not electrically shorted. In addition to the pigment, an organic binder, a surfactant and other additives are included about 30% in the black paste.

To form the first and the second black layers 80A and 80B, a process for fabricating the upper plate includes a printing process for printing the same compositional black paste as mentioned above through a screen and a mask on the upper substrate 81 having the transparent electrodes 82Y and 82Z and a firing process for solidifying the black paste. To make the thickness of the second black layer 80B thicker than that of the first black layer 80A, after a first printing process and a first firing process of a black paste are finished, the first black layer 80A is masked by a second mask, and the black paste is secondly printed on the position of the second black layer 80B through the second mask and then fired secondly. The present invention may employ a method for differently controlling the number of printing as well as a laser manufacturing and a mechanical manufacturing to make the thickness of the first and the second black layer different from each other.

The metal bus electrodes 83Y and 83Z have a pad connected to an external driving circuit at their ends and receive the driving signal such as the scanning pulse or the sustaining pulse from the external driving circuit, respectively. The outer edge of the metal bus electrodes 83Y and 83Z are substantially identical to the outer edges of the transparent electrodes 82Y and 82Z or are located on the same vertical line as those of the transparent electrode 82Y and 82Z. Moreover, the metal bus electrodes 83Y and 83Z may go in more by a certain length toward the center of the discharge cell from the outer edge. Further, the inner edge of the metal bus electrodes 83Y and 83Z are separated by the length t from the inner edge of the transparent electrodes 82Y and 82Z the same as the first embodiment described above, thereby going in more toward the outer than the related art.

On an upper plate of the PDP, a dielectric layer (not shown) deposited on the upper substrate 81 and a protective film (not shown) are further formed to cover the transparent electrodes 82Y and 82Z, the black layers 80A and 80B and the metal bus electrodes 83Y and 83Z. The upper plate of the PDP with such a structure is combined to and sealed with the lower plate shown in FIG. 1. Moreover, an inactive mixture gas such as He+Xe, Ne+Xe or He+Ne+Xe is injected into a discharge space arranged between the upper plate and the lower plate.

Figure 9:
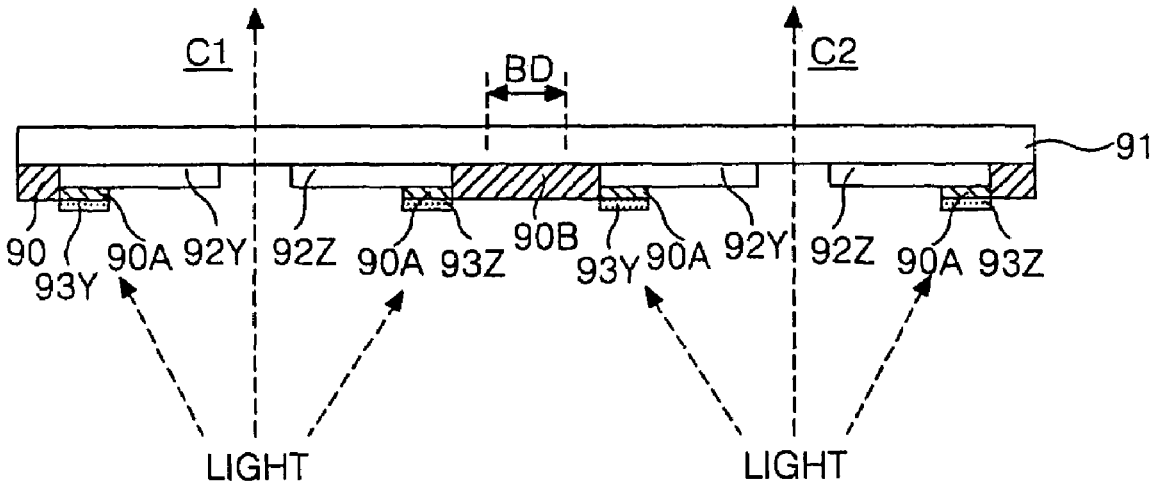
FIG. 9 is a cross-sectional view of a portion of an upper plate of a PDP according to a fourth embodiment of the present invention.

FIG. 9 is a cross-sectional view of an upper plate of a PDP according to a fourth embodiment of the present invention.

Referring to FIG. 9, the PDP according to the third embodiment of the present invention includes a transparent electrode 92 formed on an upper substrate 91 and black layers 90A and 90B formed on the upper substrate 91 and formed between transparent electrodes 92Y and 92Z and metal bus electrodes 93Y and 93Z at each of the adjacent discharge cells C1 and C2 wherein the black layers 90A and 90B have light transmittances that are partially different from each other.

The transparent electrodes 92Y and the metal bus electrode 93Y located on one side of each of the discharge cells C1 and C2 is comprised of a scanning electrode to which a scanning signal for selecting a horizontal line of the PDP during an address interval is applied and a sustaining pulse for causing a sustain discharge is applied for the discharge cell selected by an address discharge during a sustaining interval. Moreover, the transparent 92Z and the metal bus electrode 93Z located on the other side of each of the discharge cells C1 and C2 is comprised of a sustain electrode to which a sustaining pulse is applied in alternating fashion with the scanning electrode to cause the discharge cell selected by the address discharge to make a sustain discharge.

The upper substrate 91 is made of materials such as transparent glass, plastic and ceramic.

The black layers 80A and 80B include a first black layer 90A formed between the transparent electrodes 92Y and 92Z and the metal bus electrodes 93Y and 93Z at each of the discharge cells C1 and C2; and a second black layer 80B formed on the upper substrate 91 between adjacent discharge cells C1 and C2 via a boundary area BD, and connected to the transparent electrodes 92Y and 92Z neighboring the adjacent discharge cells C1 and C2.

A light shielding ratio of the first black layer 80A is lower by about 0.1%~5%, preferably about 0.1%~3%, than that of the second black layer 90B. For instance, the light shielding ratio of the first black layer 90A may be about 95%. In contrast, the light shielding ratio of the second black layer 80B is lower by about 96% than that of the first black layer 90A.

Since a light irradiated from a phosphorous material (not shown) transmits the metal bus electrodes 93Y and 93Z, and then transmits the first black layer 90A as the light transmittance of the first black layer 90A becomes higher, there are much light to go toward an display surface, thereby enhancing brightness of the discharge cell.

Since an undesirable light irradiated from the adjacent discharge cell is shut off as the light shielding ratio of the second black layer 90B becomes higher, thereby enhancing a contrast of the adjacent discharge cells C1 and C2.

In case that silver paste runs down for a printing process of the metal bus electrodes 93Y and 93Z, the distance between the metal bus electrodes 93Y and 93Z and the upper substrate 91 is made to be extended as compared with the related art, thereby preventing a discoloration of the upper substrate 91. Further, the second black layer 90B has the distance between the metal bus electrodes 93Y and 93Z and the upper substrate 91 extended to shut off a migration due to an ion elution of the electrode material, thereby preventing the discoloration of the upper substrate 91 caused by electrode material.

To make the light shielding ratio of the first and the second black layers 90A and 90B different from each other, the thickness of the first black layer 90A is thinner by about 0.1 μm~2 μm than that of the second black layer 90B. For instance, the thickness of the first black layer 90A may be selected within 2 μm while the thickness of the second black layer 90B may be selected within the range of 2 μm~4 μm.

To make the light shielding ratio of the first and the second black layers 90A and 90B different from each other, the present invention makes a pigment concentration of the first black layer 90A different from thereof the second black layer 90B. To make a light shielding ratio of the first black layer 90A higher than that of the second black layer 90B, the pigment concentration of the first black layer 90A is lower by about 1%~10% than that of the second black layer 90B. For instance, the pigment concentration of the second black layer 90B may be about 70%, while the pigment concentration of the first black layer 90A may be about 60%~69%.

A conductivity of the first black layer 90A and the second black layer 90B in the present invention is different from each other. Since the first black layer 90A is formed between the metal bus electrodes 93Y and 93Z and the transparent electrodes 92Y and 92Z, the present invention makes the conductivity of the first black layer 90A become high, thereby making a current density applied from the metal bus electrodes 93Y and 93Z to the transparent electrodes 92Y and 92Z high. Alternately, since the second black layer 90B is connected between the electrodes neighboring the adjacent discharge cells C1 and C2, the present invention makes the second black layer 90B be a non-conductivity, thereby preventing an electrical short between the adjacent discharge cells.

A conductive pigment included in a black paste of the first black layer 90A, for instance, a ruthenium oxide $Ru_xO_y$ having a low resistivity is about 60%~69% to make a current density between the metal bus electrodes 93Y and 93Z and the transparent electrodes 92Y and 92Z and a light shielding ratio high. In addition to the pigment, the concentration of an organic binder, a surfactant and other additives included in the black paste along with the pigment is about 31%~40%.

It is preferred that the concentration of the pigment having a high resistivity or non-conductivity, for instance, a cobalt oxide $Co_xO_y$, an iron oxide $Fe_xO_y$, a chrome oxide $Cr_xO_y$ and a manganese oxide $Mn_xO_y$, etc. is about 70% in a black paste of the black layer 90 so that two electrodes neighboring the adjacent discharge cells C1 and C2 are not electrically shorted. In addition to the pigment, the concentration of an organic binder, a surfactant and other additives is included about 30% in the black paste.

To form the first and the second black layers 90A and 90B, a process for fabricating the upper plate includes a printing process for printing the same compositional black paste as mentioned above through a screen and a mask on the upper substrate 91 provided with the transparent electrodes 92Y and 92Z and a firing process for solidifying the black paste. In case of making the thickness of the first black layer 90A and the second black layer 90B different from each other to make the light transmittance of the first black layer 90A higher than that of the second black layer 90B, the number of printing is different. Moreover, in case of making the pigment concentration of the first black layer 90A and the second black layer 90B different from each other to make the light transmittance of the first black layer 90A higher than that of the second black layer 90B therefor, the black pastes are differently masked and formed by a printing and firing process.

The metal bus electrodes 93Y and 93Z have a pad connected to an external driving circuit at their ends, and receive the driving signal such as the scanning pulse or the sustaining pulse from the external driving circuit. The outer edge of the metal bus electrodes 93Y and 93Z has substantially the same scheme as the outer edge of the transparent electrodes 92Y and 92Z or is located on the same vertical line as that of the transparent electrodes 92Y and 92Z. Moreover, the metal bus electrodes 93Y and 93Z may go in more by a certain length toward the center of the discharge cell from the outer edge. Further, the inner edge of the metal bus electrodes 93Y and 93Z is separated by the length t from the inner edge of the transparent electrodes 92Y and 92Z as similar as the first embodiment described above, thereby going in more toward the outer than the related art.

On an upper plate of the PDP, a dielectric layer (not shown) deposited on the upper substrate 81 and a protective film (not shown) are further formed to cover the transparent electrodes 92Y and 92Z, the black layers 80A and 80B and the metal bus electrodes 93Y and 93Z. The upper plate of the PDP with such a structure is jointed to and sealed with the lower plate shown in FIG. 1. Moreover an inactive mixture gas such as He+Xe, Ne+Xe or He+Ne+Xe is injected into a discharge space arranged between the upper plate and the lower plate.

As described above, the PDP according to the present invention includes the black layer covering the outer side and a portion of the outer upper surface of the transparent electrode and has the metal bus electrode formed on the upper surface of the black layer. Accordingly, the PDP according to the present invention shuts off the running down or the migration of the metal paste that forms the metal bus electrode to prevent the discoloration of the substrate due to the migration of the metal bus electrode or the running down of the metal paste.

Further, the PDP according to the present invention has the metal bus electrode arranged in the outer edge of the transparent electrode and biased toward the outer side of the discharge cell so that the space for the transparent electrode is increased and the aperture and brightness of each discharge cell are increased. Moreover, the PDP according to the present invention shuts off the running down or the migration of the metal paste to form a transparent electrode with various structures without the substrate discoloration.

In addition, the PDP according to the present invention forms a black layer between adjacent discharge cells, to thereby prevent the deterioration of a contrast generated by a light leakage between the adjacent discharge cells, and thus to enhance the contrast, that is, a visibility of a display picture. Further, it is possible to improve a light transmittance of the black layer between a metal bus electrode and a transparent electrode and brightness of the discharge cell, thereby enhancing a display quality.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A plasma display panel, comprising:

a transparent electrode;

a metal bus electrode;

a first light shielding layer formed between the trans parent electrode and the metal bus electrode on each discharge cell; and a second light shielding layer formed between the adjacent discharge cells, wherein the first light shielding layer and the second light shielding layer are different from each other in at least one of a thickness thereof and a concentration of a pigment thereof, and wherein the first light shielding layer and the second light shielding layer are connected to each other, wherein the pigment concentration of the first light shielding layer is lower than the pigment concentration of the second light shielding layer.

2. The plasma display panel according to claim 1, further comprising:

a substrate having the transparent electrode formed thereon, wherein the second light shielding layer is commonly connected to the transparent electrodes formed in each of the adjacent discharge cells.

3. The plasma display panel of claim 1, further comprising:

a substrate having the transparent electrode formed thereon, wherein the second light shielding layer is electrically connected to the transparent electrodes formed in each of the adjacent discharge cells.

4. The plasma display panel of claim 1, wherein the thickness of the first light shielding layer is thinner than the thickness of the second light shielding layer.

5. The plasma display panel of claim 4, wherein the thickness of the first light shielding layer is thinner by about 0.1 μm~2 μm than the thickness of the second light shielding layer.

6. The plasma display panel of claim 1, wherein the pigment concentration of the first light shielding layer is lower by about 1%~10% than the pigment concentration of the second light shielding layer.

7. The plasma display panel of claim 1, wherein the pigment of the first light shielding layer comprises a conductive pigment.

8. The plasma display panel of claim 7, wherein the pigment of the first light shielding layer includes a ruthenium oxide $Ru_xO_y$, wherein x and y are positive integers.

9. The plasma display panel of claim 7, wherein the concentration of the pigment in the first light shielding layer is about 60%~69%.

10. A plasma display panel, comprising:

a transparent electrode;

a metal bus electrode;

a first light shielding layer formed between the transparent electrode and the metal bus electrode on each discharge cell; and a second light shielding layer formed between the adjacent discharge cells, wherein the first light shielding layer and the second light shielding layer are different from each other in at least one of a thickness thereof and a concentration of a pigment thereof, and wherein the first light shielding layer and the second light shielding layer are connected to each other, wherein the pigment of the first and the second light shielding layers is a non-conductive pigment.

11. The plasma display panel of claim 10, wherein the pigment concentration of the first light shielding layer is lower than the pigment concentration of the second light shielding layer.

12. The plasma display panel of claim 10, wherein the pigment of the first and the second light shielding layers includes at least one of a cobalt oxide $Co_xO_y$, an iron oxide $Fe_xO_y$, a chrome oxide $Cr_xO_y$ and a manganese oxide $Mn_xO_y$.

13. The plasma display panel of claim 10, wherein the concentration of the pigment is about 70% in the first and the second light shielding layers.

14. A plasma display panel, comprising:

a pair of first and second substrates spaced parallel to each other and sandwiching a discharge gas space filled with a discharge gas;

a plurality of first electrodes arranged on an internal surface of the first substrate;

a dielectric layer formed on an internal surface of the first substrate and the plurality of first electrodes; and a plurality of second electrodes arranged on an internal surface of the second substrate;

wherein the dielectric layer includes a plurality of black layers between two vertically adjacent discharge cells, and the plurality of black layers includes a first black layer formed between a portion of the first electrodes and the first substrate, and a second black layer formed between adjacent first electrodes, and a thickness of the first black layer is less than 50% of a thickness of the second black layer, wherein the second black layer has a same conductivity as the first black layer.

15. A plasma display panel, comprising:

a transparent electrode;

a metal bus electrode;

a first light shielding layer formed between the transparent electrode and the metal bus electrode on each discharge cell; and a second light shielding layer formed between the adjacent cells, wherein each of the first and the second light shielding layers has a different light shielding ratio from each other, wherein a thickness of the first light shielding layer is thinner than a thickness of the second light shielding layer; and a pigment concentration of the first light shielding layer is lower than a pigment concentration of the second light shielding layer.

16. The plasma display panel of claim 15, wherein the light shielding ratio of the first light shielding layer is lower than the light shielding ratio of the second light shielding layer.

17. The plasma display panel of claim 16, wherein the light shielding ratio of the first light shielding layer is lower by 0.1%~5% than the light shielding ratio of the second light shielding layer.

18. The plasma display panel of claim 15, wherein the first light shielding layer and the second light shielding layer are different from each other in at least one of the thickness and the pigment concentration.

19. The plasma display panel of claim 14, wherein the first black layer has a different pigment concentration than the second black layer.

20. The plasma display panel of claim 14, wherein the first black layer has a different light shielding ratio than the second black layer.

21. The plasma display panel of claim 14, wherein the first black layer contacts the second black layer.

22. The plasma display panel of claim 14, wherein the thickness of the first black layer is greater than 0.5% of the thickness of the second black layer.

23. The plasma display panel of claim 14, wherein the discharge gas comprises one of He, Xe or Ne.

24. The plasma display panel of claim 14, wherein at least one of the first electrodes comprises a metal bus electrode and a transparent electrode.

25. The plasma display panel of claim 24, wherein the first black layer is formed between the metal bus electrode and the transparent electrode.

26. The plasma display panel of claim 24, wherein a color of the first black layer is darker than the metal bus electrode.

27. The plasma display panel of claim 24, wherein the first black layer has a relatively low conductivity as compared to the metal bus electrode.

28. The plasma display panel of claim 14, wherein the thickness of the first black layer is between 0.1 and 2 micrometers.

29. The plasma display panel of claim 14, wherein the first black layer comprises a black-colored layer.

30. The plasma display panel of claim 14, wherein the first black layer is made of same materials as the second black layer.

31. The plasma display panel of claim 14, wherein the first black layer is connected to the second black layer.

32. The plasma display panel of claim 14, wherein the second black layer has the thickness between 2 and 4 micrometers.

33. The plasma display panel of claim 14, wherein another dielectric layer is formed on the internal surface of the second substrate and the second electrodes.

34. The plasma display panel of claim 14, wherein the first black layer is formed on a surface of the area between the vertically adjacent discharge cells.

35. The plasma display panel of claim 14, wherein the second black layer is formed on a surface of the area between the first electrodes.

36. A color plasma display panel, comprising:

a pair of first and second substrates spaced parallel to each other and sandwiching a discharge gas space filled with a discharge gas;

a plurality of first electrodes extending horizontally and arranged on an internal surface of the first substrate;

a dielectric layer formed on the internal surface of the first substrate and the plurality of first electrodes;

a plurality of second electrodes extending vertically and arranged on an internal surface of the second substrate, wherein the dielectric layer includes a plurality of black layers between two vertically adjacent discharge cells, the plurality of black layers include a first black layer formed between a portion of one of the first electrodes and the first substrate, and a second black layer formed outside of the first electrodes, and at least one portion of the first black layer has a same thickness as the second black layer.

37. The color plasma display panel of claim 36, wherein at least one of the first electrodes comprises a metal bus electrode and a transparent electrode.

38. The color plasma display panel of claim 37, wherein the first black layer is formed between the metal bus electrode and the transparent electrode.

39. The color plasma display panel of claim 37, wherein a color of the first black layer is darker than the metal bus electrode.

40. The color plasma display panel of claim 37, wherein the first black layer has a relatively low conductivity as compared to the metal bus electrode.

41. The color plasma display panel of claim 36, wherein the thickness of the first black layer is between 0.1 and 2 micrometers.

42. The color plasma display panel of claim 36, wherein the second black layer has the thickness between 2 and 4 micrometers.

43. The color plasma display panel of claim 36, wherein the first black layer is made of the same materials as the second black layer.

44. The color plasma display panel of claim 36, wherein the first black layer is connected to the second black layer.

* * * * *